US005190506A

United States Patent [19]

Zubik et al.

[11] Patent Number: 5,190,506

[45] Date of Patent: Mar. 2, 1993

[54] ADVANCED BALANCING BOARD

[76] Inventors: Daniel M. Zubik, 181 Porter St., Watertown, Conn. 06795; Dean W. Kennedy, 237 Island Trail, Morris, Conn. 06763

[21] Appl. No.: 808,654

[22] Filed: Dec. 17, 1991

[51] Int. Cl.[5] ..... A63B 22/20

[52] U.S. Cl. ..... 482/68; 482/66; 482/146

[58] Field of Search ..... 482/66, 68, 79, 146; 280/87.041, 87.042

[56] References Cited

U.S. PATENT DOCUMENTS

| | | | |
|---|---|---|---|
| 3,630,540 | 12/1971 | Smith | 482/146 |
| 4,270,764 | 6/1981 | Yamada | 280/87.042 |
| 4,445,699 | 5/1984 | Darasko | 280/87.041 |
| 4,505,477 | 3/1985 | Wilkinson | 482/146 |
| 4,911,440 | 3/1990 | Hyman et al. | 482/146 |

*Primary Examiner*—Richard J. Apley
*Assistant Examiner*—Lynne A. Reichard

[57] ABSTRACT

The present invention pertains to a balancing board of an advanced nature which allows unique maneuverability and whose design renders a smooth performance on virtually any surface conditions both in and outdoors, to promote balance and reflex coordination skills, while providing means for recreation and freestyle maneuvers. The user stands upon a longitudinal deck which engages a precision roller assembly, with means to manipulate the deck so as to achieve linear, pivotal, and sweeping radial motions. The roller assembly contains two independently rotatable wheels mounted to a common axle, each having an interchangeable polymer tire to permit use on diverse surfaces. A special, stepped rail centrally mounted to the lower side of the deck, guides the deck along the roller and furnishes the method whereby the deck is manipulated. A limiting cable maintains the contact between the deck and roller assembly, and defines the longitudinal travel of the deck, producing a desirable stopping action at its boundaries.

6 Claims, 2 Drawing Sheets

ADVANCED BALANCING BOARD

FIELD OF THE INVENTION

The disclosed invention pertains to a balancing board of an advanced nature allowing unique traversing ability, which is used to promote balance and reflex coordination skills, while providing means for recreation and freestyle stunts both in and outdoors.

DESCRIPTION OF THE PRIOR ART

There is an array of balancing boards known in which the user stands upon a platform which rides along a roller in a longitudinal direction, and attempts to achieve a state of equilibrium.

However, these are generally comprised of a simple roller traveling inside a frame or along a track, and are limited to a linear motion only. U.S. Pat. No. 2,764,411 and U.S. Pat. No. 2,829,891 are examples of such.

Additionally, as in the cases of U.S. Pat. No. 2,829,892 and U.S. Pat. No. 4,505,477, some devices employ means to "self-center" the platform to the roller. This impairs the mobility of the board and significantly defeats the goal of promoting the users balancing skills as well.

Furthermore, U.S. Pat. No. 4,601,469 and U.S. Pat. No. 4,911,440 utilize various "keeper-pins" between their rollers and platforms in order to maintain them in contact. These boards are also limited solely to linear traversing, and such keeper-pins create a dragging effect detrimental to a smooth operation of the boards.

SUMMARY OF THE INVENTION

The present invention overcomes the aforementioned limitations and flaws of the prior art by disclosing a balancing board which allows precise longitudinal, pivotal, and radial manueverability, and which furnishes a smooth performance on virtually any surface.

Accordingly, the balancing board of the present invention employs a longitudinal deck, having a submounted stepped guide rail, engaging a precision roller assembly. A limiting cable, anchored at both ends of the deck, retains the two in contact and defines the travel limits of the roller within the confines of the deck.

The wheels of the roller assembly are independently rotatable about a common axle. Means are provided which allow the deck to be manipulated such as to permit the wheels to be driven:

1) uni-directionally at equal velocities, resulting in a linear travel;
2) oppositely, resulting in an acute pivotal motion; and
3) independently, such that the engaged wheel is driven about the pivot point created by the opposing free wheel, resulting in a sweeping radial motion.

Transition between these motions is achieved instantaneously by the exertion of moments and the alteration of the user's center of gravity, so that a challenging ride is provided by which one can develop balance coordination skills and perform freestyle feats.

The design of the wheels of the roller assembly is such that each contains a readily interchangeable polymer tire, which furnishes the option of various grade durometer tires which can be employed to accommodate use on a range of surfaces (i.e. gravel driveways to tile floors).

Therefore, the balancing board of the present invention discloses a distinguished improvement over the somewhat antiquated prior art.

BRIEF DESCRIPTION OF THE DRAWINGS

The above mentioned features, as well as other aspects and advantages, will become evident in the detailed description in reference to the included drawings.

In the drawings.

DETAILED DESCRIPTION OF THE PREFERRED EMBODIMENTS

Figure 1:
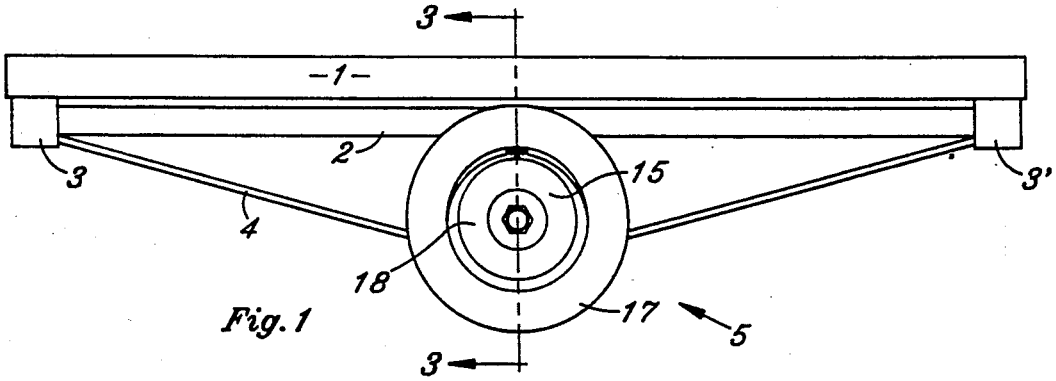
FIG. 1 is a frontal plan view of a preferred embodiment of the disclosed invention.
Figure 2:
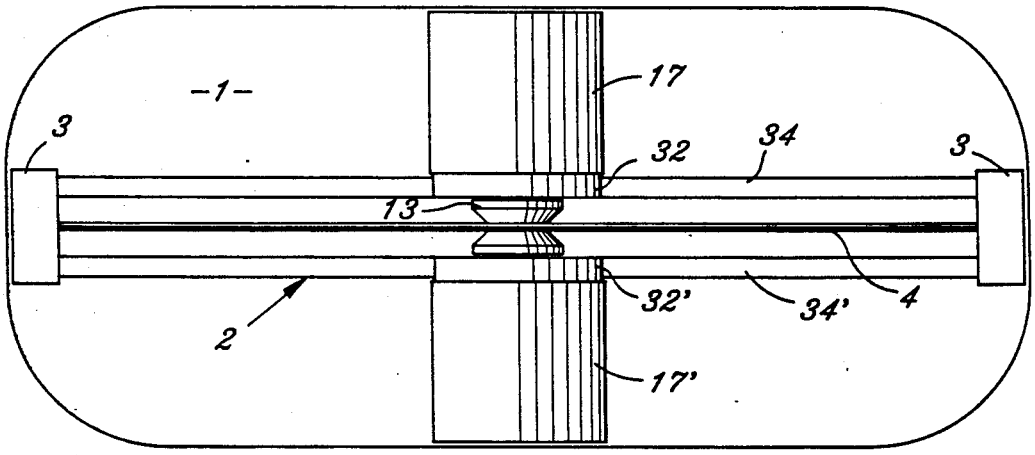
FIG. 2 is a bottom plan view of another embodiment of the device.

As portrayed in FIGS. 1 and 2, the present invention discloses a balancing board comprised of a longitudinal deck 1 engaging a precision roller assembly 5, being kept in relative contact by a limiting cable 4 anchored at both by end stops 3.

Deck 1 is rigid and inflexible, i.e. a laminate, having a planar upper surface upon which the rider stands, and a planar lower surface containing a fixed, centrally located, longitudinal stepped rail 2 which forms contact at surfaces 34 with roller assembly 5 at flange diameters 32 of hubs 15.

Figure 3:
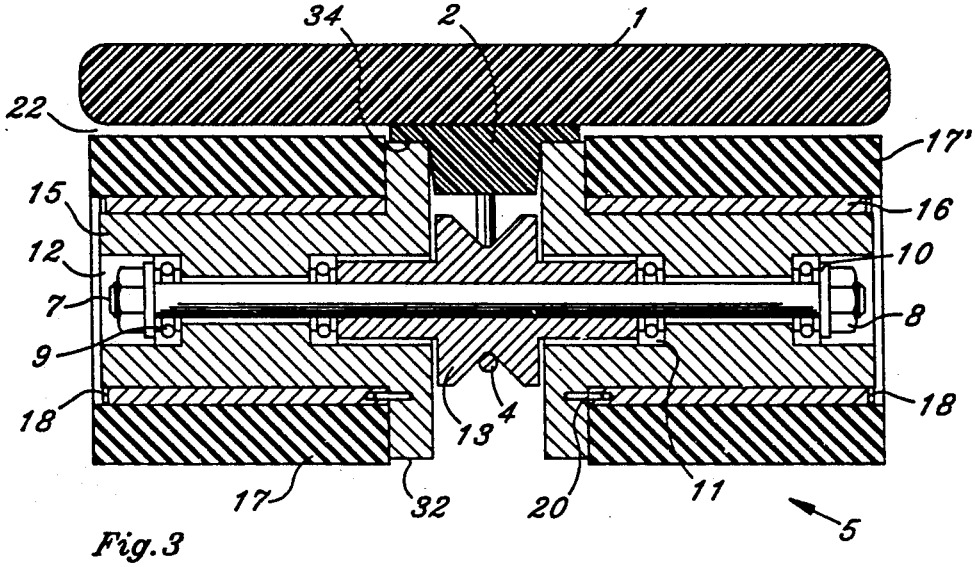
FIG. 3 is a slightly enlarged sectional view taken at section 3—3.

In roller assembly 5 of FIG. 3, a pair of polymer tires 17 are permanantly attached to cylindrical sleeves 16. The inner diameter of sleeves 16 provide a slip-fit over the body diameter of concentric, solid hubs 15. Sleeves 16 are thus releasably interchangeable on hubs 15, providing the choice of various durometer polymer tires that may be employed for operation on diverse surfaces. Sleeves 16 are interlocked to hubs 15 by lock pins 19, which are pressed into the flange of hubs 15 and which slip into coinciding holes in sleeves 16. Snap rings 18 retain sleeves 16 to hubs 15. The flange diameters 32 of hubs 15 are slightly lesser than that of tires 17, such that contact with the ground is formed by tires 17 only.

Hubs 15 are concentrically mounted to rigid, metal axle 7 by means of bearings 9 and 11, which are fitted to bored openings 12 in hubs 15. This produces the virtually frictionless, independent rotation of hubs 15, which is essential to the nature of the device. Axle 7 has a threaded segment at each end to retain hubs 15 by means of washers 10 and lock nuts 8. "V" shaped pulley 13 is centrally mounted to axle, 7, and spaces hubs 15 by abutting bearings 11, to create the adequate circumferential groove to accommodate close sliding travel of the raised center rib of rail 2.

The cross section of the center rib is slightly tapered, the bottom side being shorter, to allow compensation for angular displacement when deck 1 is tilted during operation. The overall width of rail 2 is less than the width created by flange diameters 32 of spaced hubs 15. The thickness of the outer ledges 34 of rail 2 is calculated to be substantially larger than one half the difference between the outside diiameter of tires 17 and the flange diameter 32 of hubs 15, so that the appropriate gap 22 is established between the lowerside of deck 1 and the tires 17.

Cable 4; of soft cased, high tensile core composition, is passed beneath "V" shaped pulley 13 and is anchored at each end by end stops 3 (FIG. 1).

Figure 4:
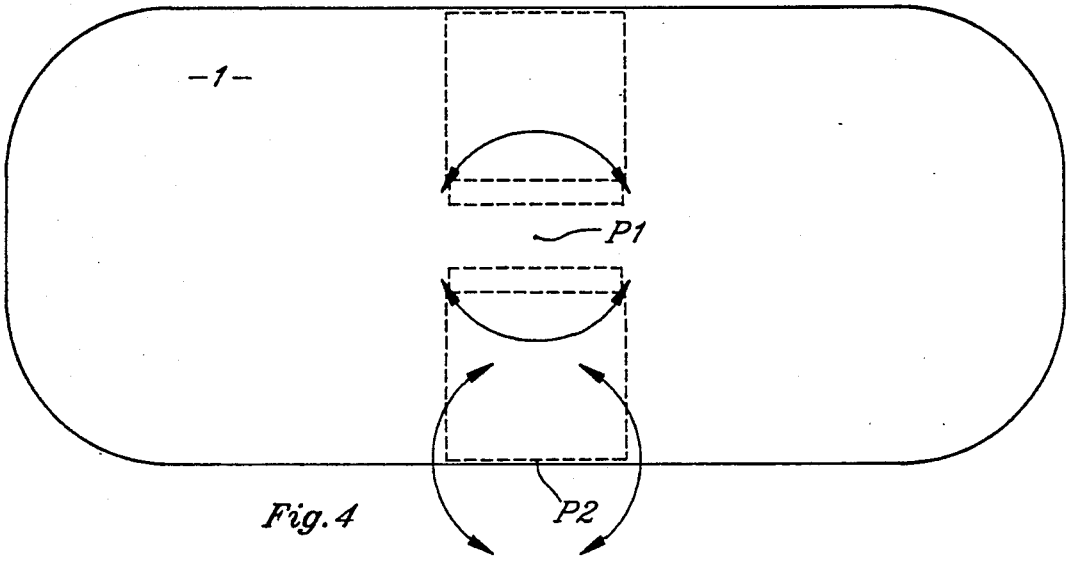
FIG. 4 is a top view showing rotational pivot points of the device.

In operation, when the user's center of gravity is positioned substantially central to the lateral axis of deck 1, the outer ledges 34 of rail 2 engage both hubs 15 at flange diameters 32, consequently rotating both wheels in the same direction uniformly to produce a straight linear traverse. By exerting a moment about the vertical center point p1 (FIG. 4), the wheels are caused to rotate oppositely, generating a sharp pivotal action about p1.

Figure 5:
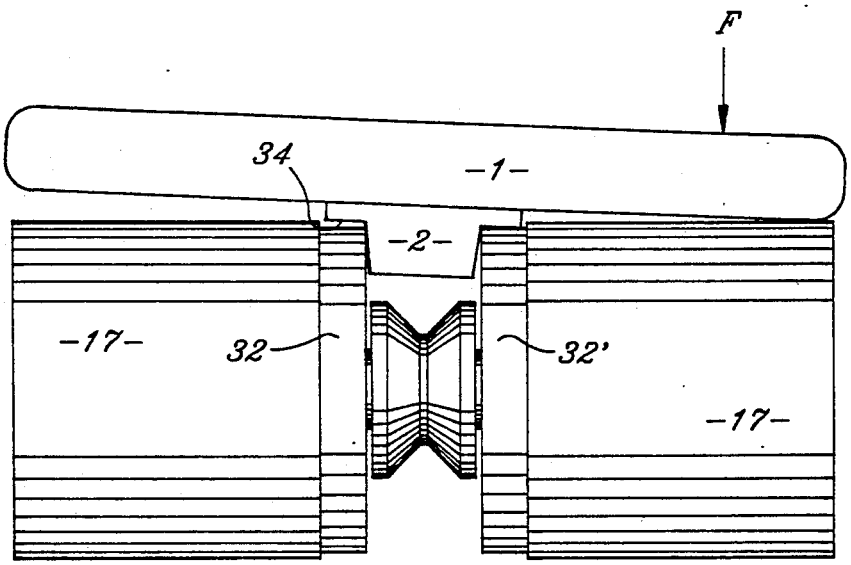
FIG. 5 is a side view shown during a rotational movement around pivot point 2 (p2), with end stops 3 and cable 4 removed to allow for a clearer view of the device.

When the users center of gravity is intentionally altered substantially past the lateral fulcrum created by rail 2 on hubs 15, deck 1 tilts (FIG. 5) so that the lower side thereof makes contact with the subsequent tire 17, and the outer ledge 34 of the opposing side of rail 2 disengages its corresponding hub 15. Consequently, when longitudinal force is applied, the engaged wheel becomes a planetary wheel driven about the axial center created by the outer edge of the opposing free wheel. This generates a sweeping, radial motion of the board.

Limiting cable 4 maintains roller assembly 5 in contact with deck 1, and confines its travel within the boundaries of the deck. The cable 4 also provides a cushioned, "wedging" effect at the end of the travel, as opposed to an abrupt halt which is undesireable.

Finally, the precision design of the present invention is crucial to the purpose of the device. Likewise, material composition (if not previously recommended) should be such as is lightweight, durable, and resistant to exposure with various elements. Light metals or plastics are suggestive examples.

It is apparent that modifications could be made to the device without departing from the scope and essence of the present invention herein described.

Therefore, what is claimed is:

1. A balancing board comprising:

a. an elongate deck having longitudinally disposed centrally on its undersurface a stepped rail, the rail defined by a central raised rib and side ledges of lesser height than the raised rib;

b. a roller assembly comprising a spaced pair of like wheels linked together for independent rotation by a central axle, each wheel comprising a rigid hub, the hubs engaging the respective ledges and closely straddling the raised rib, each wheel further comprising a resilient tire, said tire surrounding the hub such that said tire does not engage the ledges and raised rib, said roller assembly being capable of maintaining a neutral position wherein neither tire engages the elongated deck, whereby the user in riding the deck may exert force downward to one side of the deck and cause the deck to tip laterally so that the undersurface engages only the tire on one of the wheels, and the ledge of the opposing side of the stepped rail disengages its corresponding hub, to cause rotation of the engaged wheel while the other wheel idles to achieve a desired result.

2. Device of claim 1 wherein said wheels are symmetrically spaced to said axle by a "V" shaped pulley fixed centrally thereon; the ends thereof abutting said hubs, thereby defining a specific circumferential groove between said hubs.

3. Device of claim 2, wherein a limiting cable is passed beneath the angular groove of said "V" shaped pulley and is anchored at each end of said deck, said cable defining the longitudinal parameters of the travel of said roller assembly within the boundaries of said deck.

4. Device of claim 1 in which the thickness of said outer ledges of said stepped rail is substantially larger than one half the difference between the outer diameter of said tires to that of said flange diameter of said hubs, providing the calculated gap between said tires and the lowerside of said deck.

5. Device of claim 1 in which both of said outer ledges only engage said hubs when said deck is in static position.

6. Device of claim 1 in which the cross section of said raised center rib of said stepped rail is slightly trapezoidal, with its lowermost side being shorter, to accommodate angular displacement when said deck is tilted.

* * * * *